United States Patent [19]

Felix

[11] 4,122,657

[45] Oct. 31, 1978

[54] APPARATUS FOR MONITORING FOR THREAD BREAKAGE A CONTINUOUS SEQUENCE OF WORK POSITIONS ON A TEXTILE MACHINE

[75] Inventor: Ernst Felix, Uster, Switzerland

[73] Assignee: Zellweger, Ltd., Switzerland

[21] Appl. No.: 839,449

[22] Filed: Oct. 5, 1977

[30] Foreign Application Priority Data

Nov. 5, 1976 [CH] Switzerland ..... 013947/76

[51] Int. Cl.[2] ..... D01H 13/16

[52] U.S. Cl. ..... 57/81; 19/0.25; 66/163; 242/37 R

[58] Field of Search ..... 57/75, 34 R, 80, 81; 242/36, 37 R; 66/158, 162–164; 19/0.2, 0.21, 0.25; 340/259; 200/61.13, 61.18

[56] References Cited

U.S. PATENT DOCUMENTS

| | | | |
|---|---|---|---|
| 2,930,179 | 3/1960 | Bailey | 57/75 |
| 3,430,426 | 3/1969 | Bryan, Jr. et al. | 57/81 X |
| 3,498,039 | 3/1970 | Kent et al. | 57/81 X |
| 3,595,005 | 7/1971 | Saunders | 57/81 |
| 3,751,893 | 8/1973 | Goodhue et al. | 57/81 X |
| 3,911,656 | 10/1975 | Vignon | 57/81 X |
| 4,023,341 | 5/1977 | Saino et al. | 57/81 |

*Primary Examiner*—John Petrakes
*Attorney, Agent, or Firm*—Craig & Antonelli

[57] ABSTRACT

In monitoring a continuous sequence of work positions on a textile machine for thread breakage, a magnetic probe is driven along a path adjacent the ring traveler at each work position so as to generate a signal upon detection of the traveler as it rotates with the thread and provide no signal when the traveler ceases to rotate due to thread breakage. To simplify the electrical connection to the probe, the drive arrangement for the probe includes at least one conductive metallic drive band connected to the probe and to a driving source for moving the probe along the path past the work positions. A detector is then coupled to the drive band to detect the electrical signals carried thereby from the probe.

15 Claims, 7 Drawing Figures

APPARATUS FOR MONITORING FOR THREAD BREAKAGE A CONTINUOUS SEQUENCE OF WORK POSITIONS ON A TEXTILE MACHINE

This invention relates to an apparatus for monitoring for thread breakage at a continuous sequence of work positions on a textile machine.

There are many machines used in the textile industry in which many similar work positions are arranged one beside the other. Representative of such machines is, for example, a ring spinning machine. The individual spinning positions are considered as work positions and they include a drawing system and the actual spinning apparatus with spindle, ring rail with spinning rings and the travelers rotating them.

In the past, it has been necessary to monitor these spinning positions for thread breakage since it is impossible for an operator continuously to keep an eye on hundreds of spinning positions. Although technical aids have been suggested for routine monitoring, these have not been successful since with the large number of spinning positions an enormous outlay in sensors (feelers) is required, the costs of which are not justified by the result. This applies both to mechanical and to optical, electrical or any other systems for producing signals when the threads run correctly.

Statistics and an analysis of the spinning mill operation itself have shown, that it is not necessary to monitor all spinning positions continuously, but that it is possible to make an intermittent check at certain intervals in time. This solution requires only a fraction of the investment required for continuous monitoring. This case of intermittent monitoring is effected with practically the same degree of certainty as when each spinning position is observed continuously.

Based on this experience, a monitoring arrangement has to be provided for the spinning positions, which arrangement travels past the spinning positions and carries out a monitoring function based on a physical feature which clearly characterizes the difference between running and stationary (broken) thread. Detecting devices (sensors) which function without contact and which do not adversely affect the thread passing at high speed are particularly advantageous for these purposes. These detecting devices are obtained by means of optical apparatus in which changes in the light-current are evaluated by means of photo-sensitive elements.

Other known apparatus utilize the magnetic effects of the traveler rotating on the spinning ring. In this case, a sensor which responds to changes in magnetic field is fed past the parts of the traveler paths so that the traveler induces voltages in the sensor which deliver clear data about the condition of the spinning position.

All movable measuring devices have the object of transmitting the measured signal from the moving sensor to a stationary evaluation position, particularly when the sensor itself is to be designed as small as possible and without additional devices for processing the signal.

Contact bars cannot be considered for transmitting such measured signals since they do not operate reliably enough inasmuch as they tend to deliver interfering signals of about the same magnitude as the wanted signals. However, cable connections between the sensors and the evaluation positions are also very susceptible to interference since, as well as having to have great flexibility, they have to have a considerable length which has to be extended or diminished between the extreme positions of the sensor, irrespective of the fact that such a cable would interfere with the operation and maintenance of the machine.

Solutions are also known in which optical sensors are combined with a movable suction apparatus so that the latter is guided past the spinning positions on a carriage which may be driven via the machine. Although the monitoring apparatus is therefore dependent upon the pneumatic cleaning apparatus, this type of sensor movement may only be used for detecting systems operating optically which allow a predetermined clearance with respect to the relative position of the sensors to the spinning positions. In addition, the movable optical sensors require at least three cable conductors for connection to a stationary feed and evaluation instrument, more specifically a pair of cables for the light source and a pair of cables for the photo-signals.

An object of the present invention is therefore to provide an apparatus for monitoring a continuous sequence of work positions in a textile machine for thread breakage comprising a probe which is guided past the work positions, for receiving without contact electrical signals which are produced during correct thread travel and fail when there is no thread.

According to the invention, the probe is moved along the machine by a conductive metallic drive band which is an electrical connection to the probe.

The invention will now be described with reference to the accompanying diagrammatic drawings which illustrate some embodiments of the invention, and in which.

Figure 1:
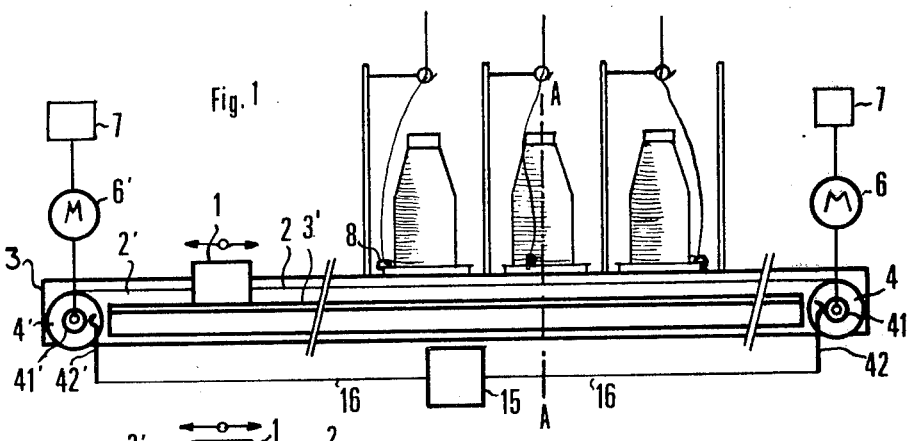
FIG. 1 is a longitudinal side view of a few spinning positions of a ring spinning machine embodying a work monitoring arrangement in accordance with the present invention.

In the embodiment illustrated in FIG. 1, an apparatus according to the present invention is provided on a ring spinning machine and comprises a probe 1 which is driven to and fro along a ring rail 3 of the ring spinning machine, the probe being guided on a guide rail 3'. A pair of drive bands 2,2' are connected at the ends thereof to both sides of the probe 1.

The bands 2,2' cause the probe 1 to be moved along the machine on the guide rail 3'. In the arrangement in FIG. 1, the bands 2,2' are wound on winding reels 4,4' which release the band at one end and wind it up at the other end as the probe is moved. These winding reels are each driven alternately by a motor 6,6' so that the bands 2,2' drive the probe past the respective spinning positions in a reciprocating manner. Terminal stops (not shown) which may be of known construction act through switch components 7, to reverse the direction of movement of the probe 1 when it reaches the terminal positions, in the well-known manner.

The bands 2,2' are metallic conductors and are electrically connected to the outputs of the probe 1 so that they form a part of an electric circuit in which the signals received by the probe 1 can travel. The metallic conductors of the bands 2,2' may be bare metallic strips, metallic cords, metallic wires, or the like, but these may also be clad in insulating material.

Figure 3:
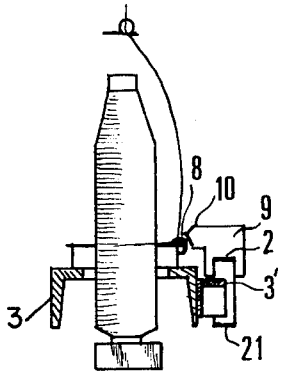
FIG. 3 is a sectional view taken along line A—A in FIG. 1.

The probe 1 has the form of a magnetic feeler which responds when a traveler 8 passes the probe during the normal spinning operation. A permanent magnet 9 (FIG. 3) with a projecting nose 10 is provided for this purpose. The nose 10 is positioned as close as possible to the paths of the travelers 8 so that the travelers may influence the magnetic field of the probe as it passes.

The guide rail 3' is preferably made of magnetically conductive material and is fixed directly on the ring rail 3 or on a support element of the rail 3 so as to form a part of a magnetic path by which the magnetic resistance may be kept low for the circular magnetic field influenced by the travelers 8. The path of the vertical ring rail movement also follows from this. In addition, the profile of the guide rail 3' over the entire length of the ring rail may be formed in such a way that it acts not only as a guide member but also as a protective cover for the bands 2,2'.

The principle of magnetic induction only requires a twopole connection, since no supply voltages have to be transmitted but only signal voltages. When there are changes in the magnetic resistance as a result of the presence of a traveler in the field of the magnet 9, electrical voltages are produced in a winding 11 surrounding the permanent magnet 9. These voltages may be evaluated as signals of thread travel. The signals are produced during correct thread travel, but cease when there is no thread, since the traveler 8 will cease to rotate upon thread breakage, as is well known.

Figure 5:
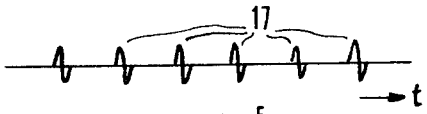
FIGS. 5 and 6 are diagrams which illustrate respective pulse trains.

The winding reels 4,4' each have a slip ring 41, 41' and sliding contacts 42,42'. These contacts are connected by conductors 16 to an evaluating component 15. Since the slip rings and sliding contacts are part of the winding reels 4,4', they may be designed so as to ensure reliable transmission of signals. As seen in FIG. 5, alternating current pulses 17 are detected by the evaluating component 15 as the probe 1 travels along the machine, each pulse representing the presence of a thread at one of the individual spinning positions.

Figure 2:
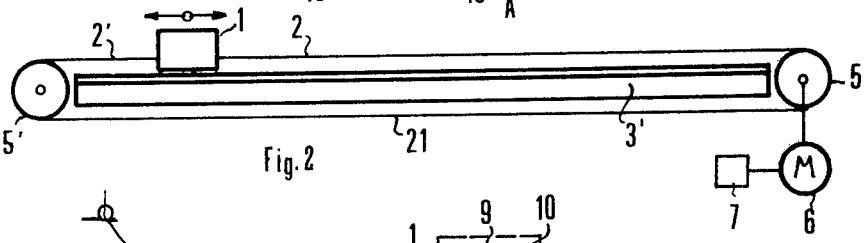
FIG. 2 is a schematic diagram of a second embodiment of the invention.

In an advantageous modification of the apparatus according to FIG. 1, the free ends of the bands 2,2' are not wound on the winding reels 4,4' but are passed round motor driven guide rollers or pulleys 5,5' (FIG. 2) and joined to form an endless loop 21. In this case, the joint between the ends of the bands 2,2' is formed by an insulator. Again, the guide rollers 5,5' may be used to transmit the electric current for the signals and for this purpose will be provided with slip rings 41,41' and sliding contacts 42,42', similar to those of the winding means 4,4' in FIG. 1.

Figure 4:
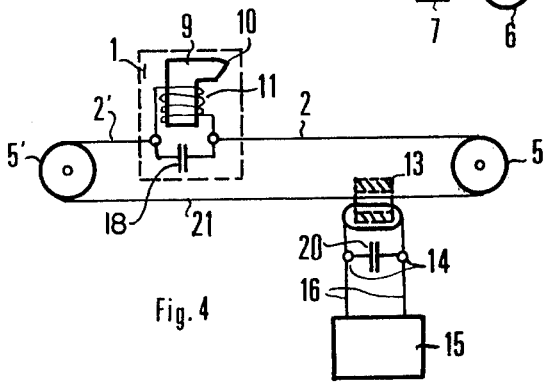
FIG. 4 is an electrical circuit diagram illustrating details of the present invention.

However, a conductive connection of the ends of the bands 2,2' into an endless loop 21 is also particularly advantageous. In this case, the loop 21 closes the electrical circuit for the winding 11 of the probe 1 and corresponding currents flow into it and represent instantaneous alternating current pulses 17 (FIG. 5). These alternating current pulses may be detected at a suitable point, as seen in FIG. 4, by a transformer 13 of the series transformer type so that a metallic contact between the loop 21 and the stationary evaluating component 15 is not required. Thus, all interferences which would have to be eliminated by structural measures through the slip ring transmission in FIG. 1 are avoided. The voltages occurring at the terminals 14 of the transformer 13 may be connected to the evaluating component 15, which is placed at any suitable position, by lines 16 which may optionally be shielded.

Figure 6:
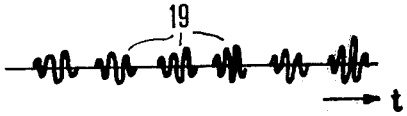

A further improvement of the probe 1 may be obtained by connecting a capacitor 18 in parallel with the winding 11 and completing the winding 11 to form an oscillator circuit, the natural frequency of which may be turned to that of the pulses 17 (FIG. 5). The pulses 17 are thus transformed in the bands or loop to short pulse trains 19 (FIG. 6). This produces an even better identification of the actual thread travel signals in relation to interfering voltages which may occur in each case and which may extend in the bands 2,2' or over the loop 21. Similarly, the winding of the transformer 13 may be completed to form an oscillator circuit by means of another capacitor 20.

Figure 7:
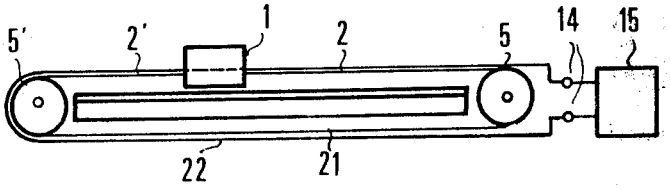
FIG. 7 is a longitudinal side view of a third embodiment of the present invention.

FIG. 7 shows a variation for inductive transmission of the signal pulses 17, 19 from the moving loop 21 to the evaluating component 15. It comprises a stationary conductive loop 22 which is disposed in parallel to the loop 21 over the entire length thereof and which acts as a secondary winding coupled to the moving loop 21. The signal currents circulating in the moving loop 21 may be induced in the loop 22 so that the signal may be transmitted to the evaluating component 15 without metallic contact.

While I have shown and described several embodiments in accordance with the present invention, it is to be understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. An apparatus for monitoring a continuous sequence of spaced work positions on a textile machine for thread breakage, comprising a probe for generating an electric signal upon detection of a thread, means for moving said probe on a path along the textile machine past the work positions so as to generate said electric signal at each work position where a thread is detected without contact with elements of the textile machine, which signals are produced at each work position only during correct thread travel and fail when there is no thread, said means for moving the probe along the textile machine including at least one conductive metallic drive band which forms an electrical connection to the probe, and detector means for detecting said electrical signals carried by said drive band.

2. An apparatus according to claim 1 wherein the probe is arranged to move on a guide rail fixed to a ring rail of a ring spinning machine.

3. An apparatus according to claim 2 wherein the guide rail is made of magnetically conductive material so as to form part of a magnetic circuit for detecting the movement of a ring traveler.

4. An apparatus according to claim 2 wherein the guide rail has a configuration to also provide a protective cover for the drive band.

5. An apparatus according to claim 1 wherein said means for moving the probe along the textile machine includes two conductive drive bands each having ends connected to opposite sides of the probe, the other ends of the bands being wound on alternately driven winding means.

6. An apparatus according to claim 5, wherein said winding means includes electrical contact means cooperating with sliding contacts which are electrically connected to said detector means.

7. An apparatus according to claim 1 wherein said conductive drive band is an endless conducting loop passed over guiding rollers.

8. An apparatus according to claim 7 wherein said conductive loop is coupled to a stationary transformer in such a way that pulses circulating in the loop may be fed through the transformer to said detector means.

9. An apparatus according to claim 8 wherein a capacitor is connected in parallel to the winding of the transformer.

10. An apparatus according to claim 7 further including a stationary loop acting as a secondary winding disposed in parallel to the endless conducting loop and connected to said detector means.

11. An apparatus according to claim 1 wherein said drive band is a bare metallic conductor.

12. An apparatus according to claim 1 wherein said drive band is an electrical conductor clad by insulating material.

13. An apparatus according to claim 1, wherein said probe includes a magnetic core surrounded by a winding.

14. An apparatus according to claim 13 wherein a capacitor is connected in parallel to the winding.

15. An apparatus according to claim 13 wherein the magnetic core of the probe has a nose directed towards the path of a ring traveler located at each work position.

* * * * *